United States Patent [19]

Rebstock

[11] Patent Number: 4,996,087

[45] Date of Patent: Feb. 26, 1991

[54] PERSONALIZED ORNAMENT HAVING A DESIGN OUTLINE

[76] Inventor: Roland B. Rebstock, 1642 Nie Parkway, New Orleans, La. 70114

[21] Appl. No.: 378,316

[22] Filed: Jul. 11, 1989

[51] Int. Cl.[5] ..... A47G 33/08

[52] U.S. Cl. ..... 428/11; 428/32; 428/187; 434/84

[58] Field of Search ..... 118/76; 427/11; 428/7, 428/11, 32, 187; 156/62; 434/84, 85

[56] References Cited

U.S. PATENT DOCUMENTS

| | | | |
|---|---|---|---|
| 1,205,779 | 11/1916 | Peck | 434/84 X |
| 2,380,126 | 7/1945 | Sturm | 524/277 X |
| 2,770,213 | 11/1956 | Rekettye | 118/76 |
| 3,802,104 | 4/1974 | Wiley | 428/11 X |
| 3,829,348 | 8/1974 | Spiegel et al. | 428/11 |
| 4,173,667 | 11/1979 | Rusch | 428/11 |
| 4,224,358 | 9/1980 | Hare | 428/485 X |
| 4,285,746 | 8/1981 | DePuy et al. | 428/11 X |
| 4,309,464 | 1/1982 | Rauch | 428/11 |
| 4,491,494 | 1/1985 | Davis, Jr. et al. | 428/11 X |
| 4,584,042 | 4/1986 | Wandroik | 428/486 X |
| 4,627,110 | 12/1986 | Tengs | 2/115 X |

OTHER PUBLICATIONS

Page 17, Aug. 17, 1980 Parade, "Beautiful Christmas".

*Primary Examiner*—Henry F. Epstein
*Attorney, Agent, or Firm*—Thomas S. Keaty

[57] ABSTRACT

The invention relates to a method of making decorative ornaments of personalized nature. The method provides for the use of a three-dimensional ornament which is covered by a coating having acrylic resin and then one-color outline of a design is printed on the coating. The space formed within the outline of the design serves as a coloring space for an individual. A second method provides for the use of a heat-shrinkable plastic sleeve positionable about an object and exposable to heat to cause shrinking of the sleeve to conform to the shape of the ornament. In this embodiment, a one-color outline is imprinted directly on the sleeve prior to positioning of the sleeve on the three-dimensional ornament.

3 Claims, 1 Drawing Sheet

PERSONALIZED ORNAMENT HAVING A DESIGN OUTLINE

BACKGROUND OF THE INVENTION

Field of the Invention

The present invention relates to decorative ornaments and more particularly, to such ornaments as Christmas tree ornaments, or the like, which can be finalized by an individual in accordance with his/her individual taste.

Decorative ornaments which can be personalized by an individual are known in the art. Some of the ornaments are personalized by adhering a personalized picture to a ball coated with acrylic co-polymer and subsequently applying a second protective coating to the ball, thus permanently securing the picture to the ball (see U.S. Pat. No. 4,309,464 issued on Jan. 5, 1982 to Rauch).

Other ornaments provide for the use of a spherical transparent ball having one flattened face portion along one side, so that a picture of an individual can be embedded into the side face portion of the ball, and since the face of the picture is directed toward the center axis of the transparent ball, a viewer facing the ball from the side opposite the flattened face portion will see a magnified picture (U.S. Pat. No. 3,802,104 issued to Wiley on Apr. 9, 1974).

Still, another example of a personalized ornament is seen in U.S. Pat. No. 4,173,667 issued on Nov. 6, 1979 to Rusch. The Christmas ornament in accordance with that patent is made from a pair of transparent hemispherical housings which are lockable to form a ball. Prior to fitting the hemispheres to each other, a greeting card with a personalized message on one side and a photograph of an individual on the other side can be fitted between the hemispheres and suspended by the same hang rod as the ornament itself.

While offering various methods of personalizing the ornaments, the known methods are not adaptable for use by small children, since they require a certain expertise in handling of coatings, and various adhesives.

It is, therefore, an object of the present invention to provide a Christmas ornament and a method of making same which will be simple enough to be used by children.

It is another object of the present invention to provide a kit for making an ornamental article of a personalized nature.

These and other objects of the present invention will be easily apparent to those skilled in the art from the foregoing description of the invention.

SUMMARY OF THE INVENTION

The present invention solves the shortcomings of the prior art and achieves its objects and a simple and straightforward manner.

In accordance with the present invention, an ornament to be personalized is coated with an acrylic coating and a design is drawn on the coated surface. The ornament is personalized by painting within the outlines of the ornament by crayons, or similar coloring means, thus allowing a child to actively participate in preparation of a Christmas tree decoration or a personalized gift.

Alternatively, the ornament can be prepared by placing over the article a cylindrically shaped, shrinkable "sleeve" on which an outline of the design is inked or otherwise permanently imprinted. The ornament is then treated by heat to allow shrinkage of the sleeve to conform to the shape of the ornament, after which the ornament can be personalized by coloring within the outlines provided by the design, using crayons or other coloring means.

The kit for making the personalized ornaments is provided with an ornament ready for accepting coloring, a set of coloring means, such as a box of crayons, and may contain some examples of the color scheme which could be utilized in personalizing the ornament by an individual.

Other aspects and details of the present invention will be apparent from the following description of the preferred embodiment of the invention and the drawings.

DESCRIPTION OF THE PREFERRED EMBODIMENT

Figure 1:
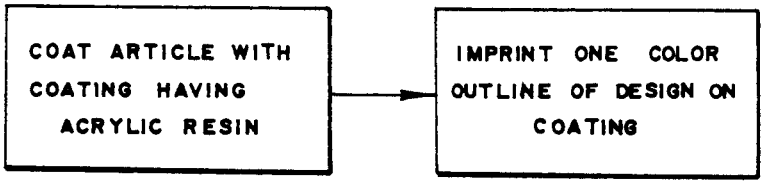
FIG. 1 is a block diagram of one embodiment of the method of making a personalized ornament in accordance with the present invention.
Figure 2:
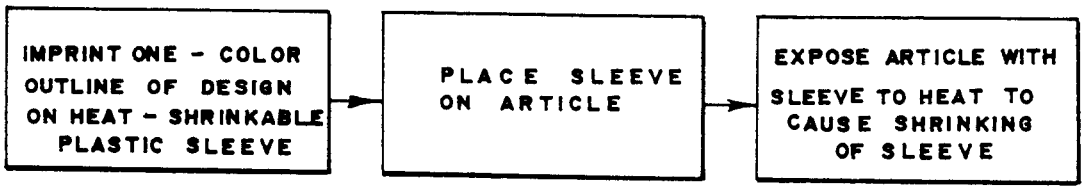
FIG. 2 is a block diagram of another embodiment of the method of making a personalized ornament in accordance with the present invention.
Figure 3:
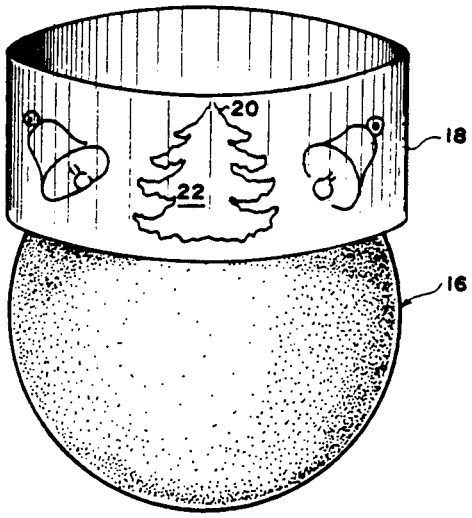
FIG. 3 is a perspective view of an ornament being made in accordance with one embodiment of the present invention.
Figure 4:
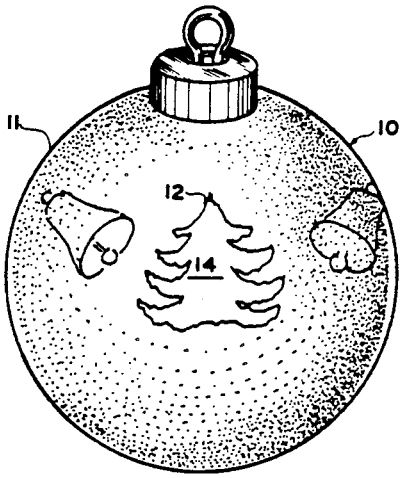
FIG. 4 is a perspective view of an ornament made in accordance with another embodiment of the present invention.

Referring now more specifically to the drawings, a decorative ornament in accordance with the present invention is generally designated by numeral 10 having a spherical core and covered by a strand material, for example, rayon acetate yarn or textured polyester yarn wound about the outer surface of the core.

The core is prefectly made of a plastic material, for example, polystyrene, so that when pressure is applied to the outer surface of the core, the ornament is not destroyed.

It should be noted, however, that the shape of the ornament does not have to be spherical and other shapes, such as stars, pyramids, ellipsoids, prisms, and the like can be used, depending on the specific kit made in accordance with the present invention. However, it is preferable that the core of the ornament be made sufficiently sturdy and not fragile.

In accordance with one of the embodiments of the present invention, a coating having an acrylic resin is deposited on the outer surface of the strand material to provide for a smooth, non-yellowing surface 11.

A one-color outline 12 of the desired design is then imprinted on the ornament, directly on the acrylic coating, in for example, black ink, leaving the space 14 within the outline uncovered, similar to a "coloring book". The kit (not shown) which incorporates the ornament prepared in accordance with the above-described method, also comprises a set of crayons, to enable a child to paint directly on the ornament within the space 14, being dictated only by his imagination.

Alternatively, the kit will also contain a number of illustrations of color schemes to enable the child, at least at the initial stage, to follow an example and learn color coordination to produce an esthetic ornament.

It has been found that a coating comprising an acrylic resin readily accepts crayon marking and drawing and retains the colored decoration for an indefinite period of time.

And since the core of the ornament is made of sturdy plastic, any pressure which is exerted by an inexperienced hand of a child will not destroy the ornament itself. The ornament of the present invention serves an educational purpose by allowing a child to achieve a set goal without frustration often associated with handling fragile objects. The ornament prepared in this manner is highly personalized, reflects the child's imagination and stimulates his desire to learn proper handling of crayons or other coloring instruments.

In accordance with another method of the present invention, the ornament 16 having a strand material wound about a core, is covered by a heat shrinkable plastic sleeve 18 which has a one-color outline 20 of a design imprinted thereon prior to positioning the sleeve on the core. Thus, a space 22 is formed by the outline 20, in which a child can paint, color or draw to form a personalized ornament. For spherical objects, the plastic sleeve 18 may be of a cylindrical shape, which is easily conformed to the sphere by exposing the ornament with the sleeve positioned thereon to heat and allowing the cylindrical sleeve to shrink, thus acquiring the spherical shape.

It is also possible to form suitable sleeves for differently shaped ornaments, which is well known to those skilled in the art. The plastic cover formed on the outside of an ornament provides a smooth surface ready to receive coloring by crayons or other coloring means in the manner described hereinabove.

It should be noted that the ornaments formed in accordance with the present invention do not have to be made with polystyrene cores, if the kit is designed to be handled by an adult. In this case, an acrylic coating on even a glass ornament with an outline imprinted on the coating would be feasible.

The design which is printed on the ornaments may be of any nature, for example, traditional Christmas designs of Santa Claus, Christmas trees or any other suitable designs for various occasions to be personalized by an individual who colors the ornament.

Many other modifications and changes can be readily made by those skilled in the art, without departing from the spirit and scope of this invention.

Therefore, I pray that my rights to the invention be limited only by the spirit and scope of the appended claims.

I claim:

1. A decorative ornament, comprising:

a core having a smooth exterior surface and a coating suitable for receiving a multi-color drawing;

an indicia disposed upon said coating, said indicia including a one-color outline of a design imprinted on said coating, a non-colored space within the outline forming coloring space for subsequent coloring by an individual.

2. The ornament of claim 1, wherein said coating comprises an acrylic resin.

3. The ornament of claim 1 wherein said coating is a plastic sleeve made of heat-shrinkable material and conforming to a shape of the core.

* * * * *